US010549878B2

(12) United States Patent
Ickert et al.

(10) Patent No.: US 10,549,878 B2
(45) Date of Patent: Feb. 4, 2020

(54) OBJECT CARRIER AND PACKAGING SYSTEM

(71) Applicant: Multivac Sepp Haggenmüller GmbH & Co. KG, Wolfertschwenden (DE)

(72) Inventors: Lars Ickert, Kempten (DE); Alireza Taghipour, Kempten (DE)

(73) Assignee: Multivac Sepp Haggenmüller SE & Co. KG, Wolfertschwenden (DE)

( * ) Notice: Subject to any disclaimer, the term of this patent is extended or adjusted under 35 U.S.C. 154(b) by 847 days.

(21) Appl. No.: 15/040,933

(22) Filed: Feb. 10, 2016

(65) Prior Publication Data

US 2016/0236809 A1 Aug. 18, 2016

(30) Foreign Application Priority Data

Feb. 12, 2015 (EP) ..... 15154871

(51) Int. Cl.

| | |
|---|---|
| ***B65D 1/36*** | (2006.01) |
| ***B65B 5/08*** | (2006.01) |
| ***B65B 7/16*** | (2006.01) |
| *B65B 43/52* | (2006.01) |
| *B65B 31/02* | (2006.01) |

(52) U.S. Cl.

CPC ..... *B65D 1/36* (2013.01); *B65B 5/08* (2013.01); *B65B 7/164* (2013.01); *B65B 31/028* (2013.01); *B65B 43/52* (2013.01)

(58) Field of Classification Search

CPC .. B65D 1/36; B65B 5/08; B65B 7/164; B65B 31/028; B65B 43/52; B65B 5/068; B65B 35/44; B65B 61/28; B29C 33/0022; B29C 33/301; B23Q 7/1484; B41B 17/10

USPC ..... 53/246, 171

See application file for complete search history.

(56) References Cited

U.S. PATENT DOCUMENTS 2,811,933 A * 11/1957 Prasz ..... A23G 1/26 425/453
3,570,211 A * 3/1971 Gordon ..... B65B 43/44 53/55
4,296,589 A * 10/1981 Kruse ..... B65B 7/164 156/522

(Continued)

FOREIGN PATENT DOCUMENTS

DE 2053324 A1 5/1971
EP 0559293 A1 9/1993

(Continued)

*Primary Examiner* — Robert F Long
*Assistant Examiner* — Xavier A Madison
(74) *Attorney, Agent, or Firm* — Husch Blackwell LLP

(57) ABSTRACT

The invention relates to an object carrier comprising a two-dimensional array of receptacles for trays having n rows and m lanes, with n and m each being integers equal to or greater than 2. The object carrier includes a plurality of notch elements provided on one or two mutually parallel outer sides. The invention further relates to a packaging system comprising a packaging machine, a transport system, at least one processing unit, and several multi-row object carriers. Several stop systems are provided along the transport system and are configured to stop an individual object carrier in an intermittent mode at consecutive notch elements of the object carrier in order to have at least one row of trays be processed by the processing unit.

11 Claims, 9 Drawing Sheets

(56) References Cited

U.S. PATENT DOCUMENTS

| | | | | |
|---|---|---|---|---|
| 2010/0270124 | A1* | 10/2010 | Heck | B65B 35/44<br>198/468.6 |
| 2012/0037271 | A1* | 2/2012 | Davidson | B65B 1/06<br>141/129 |

FOREIGN PATENT DOCUMENTS

| | | | |
|---|---|---|---|
| FR | 2963322 | A1 | 2/2012 |
| GB | 2500639 | A | 10/2013 |

* cited by examiner

OBJECT CARRIER AND PACKAGING SYSTEM

CROSS-REFERENCE TO RELATED APPLICATIONS

This Application claims priority to European Patent Application Number 15154871.6 filed Feb. 12, 2015, to Lars Ickert and Alireza Taghipour, currently pending, the entire disclosure of which is incorporated herein by reference.

FIELD OF THE INVENTION

The invention relates to an object carrier and a packaging system.

BACKGROUND OF THE INVENTION

Not yet published European Patent Application Number 14197424.6 discloses a packaging system with a packaging machine, a loading station for trays and a lifting station for sealed packages. Object carriers are provided that can each accommodate a plurality of trays. The object carriers are transported via conveyor belts from one station or packaging machine, respectively, to the other station. For example, all trays are loaded at a loading station into an object carrier while the latter is stopped at a designated position. Such an automated device for loading the trays is still somewhat inflexible in spite of all its advantages.

SUMMARY OF THE INVENTION

One object of the present invention is to provide even more flexible and more efficient operation of such a packaging system.

The object carrier according to one embodiment of the present invention comprises a carrier plate, a two-dimensional array of receptacles for packaging trays having n rows and m lanes, and is characterized in that the object carrier comprises a plurality of notch elements (or latch elements) that are provided at one or two outer sides during operation that is parallel to the intended direction of transport. Here, n and m are integers and are each at least 2. The object carrier may be stopped by way of the notch elements at different positions on a conveyor belt at a processing unit, so that the processing unit can consecutively treat an individual row or a group of adjacent rows of trays, respectively. This can reduce the cost and effort for the processing unit and increases flexibility, in contrast to simultaneous processing of an entire format consisting of several rows and lanes.

By arranging the notch element on the outer sides parallel to the intended direction of transport, one notch element can be provided at each one of the n rows, since a row of receptacles, trays or packages of an object carrier is oriented transverse to a direction of transport.

Receptacle is understood within the context of one embodiment of the present invention to be a depression or even an end-to-end opening into each of which a packaging tray can be inserted so that this tray, during transport by way of the object carrier, maintains a defined position on the object carrier. If the tray has an edge, a shoulder for example, can be provided within the receptacle or a web encircling the receptacle adjacent to the receptacle, on which the edges of the tray can rest.

The carrier plate of the object carrier may have a length and width of at least 300 mm×300 mm. A thickness of 10 to 30 mm has proven to be advantageous. The carrier plate can comprise, for example, aluminum or stainless steel or even be made entirely of one of these two materials.

It is conceivable that the notch elements are formed integrally with the carrier plate, for example, by a milling operation.

The notch elements may be disposed on one or on both sides of the object carrier equidistant from one another, for example, at respective outer sides of the carrier plate of the object carrier. The distance between mutually adjacent notch elements on the same side of the object carrier preferably corresponds to the distance (for example, the center-to-center distance) of the receptacles of adjacent rows of receptacles or an integral multiple thereof. It is conceivable, for example, that the distance between adjacent notch elements corresponds to two or three times the distance between two rows of receptacles from reach other.

In one embodiment, the object carrier comprises one notch element for every row in order to achieve a low structural complexity and low cost expenditure for the tools of the processing units.

A centering element associated with every notch element can be provided in order to minimize or eliminate possible play of the notch element at a stop system by use of a centering device of the processing unit, so that maximum positioning accuracy can be obtained. The centering element may be a centering hole capable of cooperating with a centering pin in a structurally simple manner A packaging system according to one embodiment of the present invention comprises a packaging machine, a transport system, at least one processing unit and several multi-row object carriers, as described above, and may be characterized in that several stop systems are provided along the transport system and configured to stop an individual object carrier in an intermittent mode at consecutive notch elements of this object carrier in order to have at least one row of trays be processed by the processing unit. One advantage of this embodiment is a significantly reduced effort for retooling the processing units because only tools for processing one row of trays, products or packages need to be exchanged. The processing units do not need to comprise elaborate tools for large formats with several rows and lanes, but only for one row.

The processing unit of the packaging system may be a tray loader, a filler, a product loader, a capper, a robot or a labeler.

The packaging machine can be a tray sealer for sealing a top film onto trays that are located in the object carriers and filled with a product. Prior to sealing, the trays can further be evacuated and/or aerated to extend the shelf life of the products.

In one embodiment, the processing unit comprises a centering device to align the object carrier by way of the centering element. An exact position of the object carrier or the row relative to the tool of the processing unit is thereby obtained.

Other and further objects of the invention, together with the features of novelty appurtenant thereto, will appear in the course of the following description.

DESCRIPTION OF THE SEVERAL VIEWS OF THE DRAWING

In the following, an advantageous embodiment of the invention is further illustrated using a drawing, where.

Same components are designated throughout the figures with the same reference numerals.

DETAILED DESCRIPTION OF THE INVENTION

Figure 1:
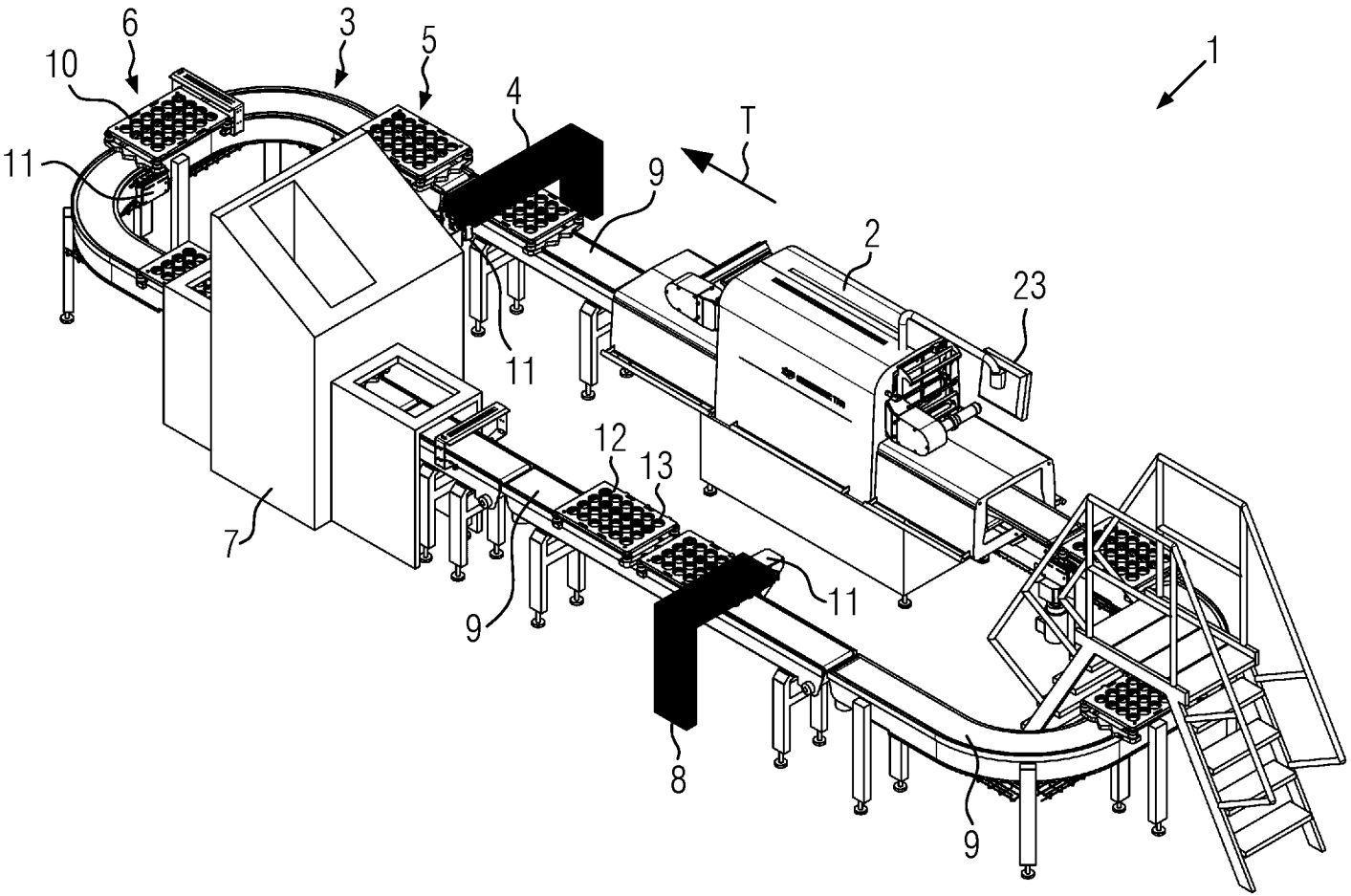
FIG. 1 is a schematic perspective view of a packaging system according to one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a schematic view of a packaging system 1 according to one embodiment of the present invention with a tray sealer 2 and a transport system 3 having a direction of transport T. Provided downstream of tray sealer 2 in direction of transport T are processing units such as, for example, a labeler 4 for labeling finished packages, a removal device 5, a loader 6 for trays in an object carrier 10, a filler 7 and a loader 8, for manually loading additional products or for placing a lid. By way of the transport system 3 comprising a plurality of conveyor belts 9, the packaging system 1 may have a ring-like closed transport path for object carriers 10. Based on a single conveyor belt 9, T denotes the direction of transport of this conveyor belt 9 during operation. Based on the entire transport system 3 illustrated in FIG. 1, T denotes the direction of circulation of object carriers 10 along the entire ring-like closed transport system 3.

Each of processing units 4, 5, 6, 7, 8 can comprise a stop system 11. Object carriers 10 can comprise three notch elements 12 that are in the direction of transport T on their left side 10*a*, (i.e., on the side facing the inside of the ring-like closed transport path) so that stop system 11 stops object carrier 10 consecutively in an intermittent operation at individual notch elements 12 and thereby enables partial processing of a respective subgroup of trays 13 in object carrier 10. This subgroup respectively contains all trays 13 in one, two or, for example, also three adjacent rows R of receptacles 14. Exact positioning of trays 13 relative to processing units 4, 5, 6, 7, 8 may be achieved by associating notch elements 12 to stop system 11 and thereby to processing unit 4, 5, 6, 7, 8.

Figure 2:
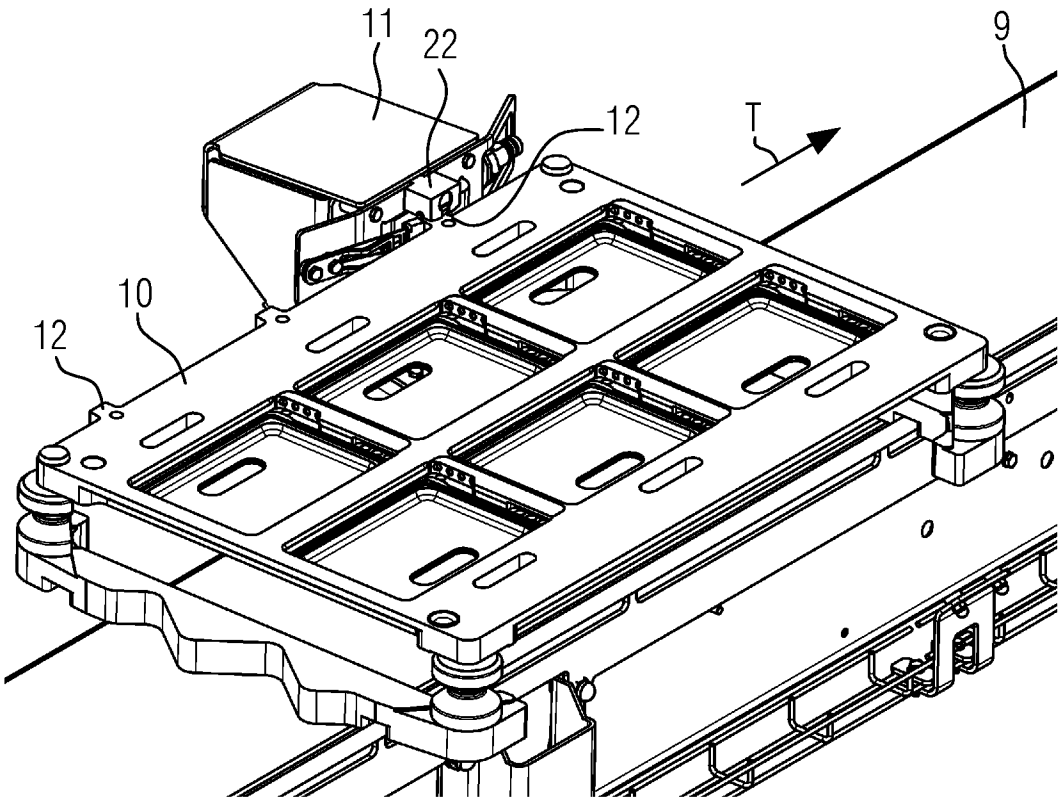
FIG. 2 is a perspective view of a stop system with an object carrier according to one embodiment of the present invention.

FIG. 2 shows a view of stop system 11 with object carrier 10 according to one embodiment of the present invention in a position in which notch element 12, in the direction of transport T of conveyor belt 9 being the leading one, is stopped by stop system 11, so that a respective processing unit 4, 5, 6, 7, 8, presently not shown in more detail, can process the first row R of trays 13, products, or already sealed packages.

Figure 3:
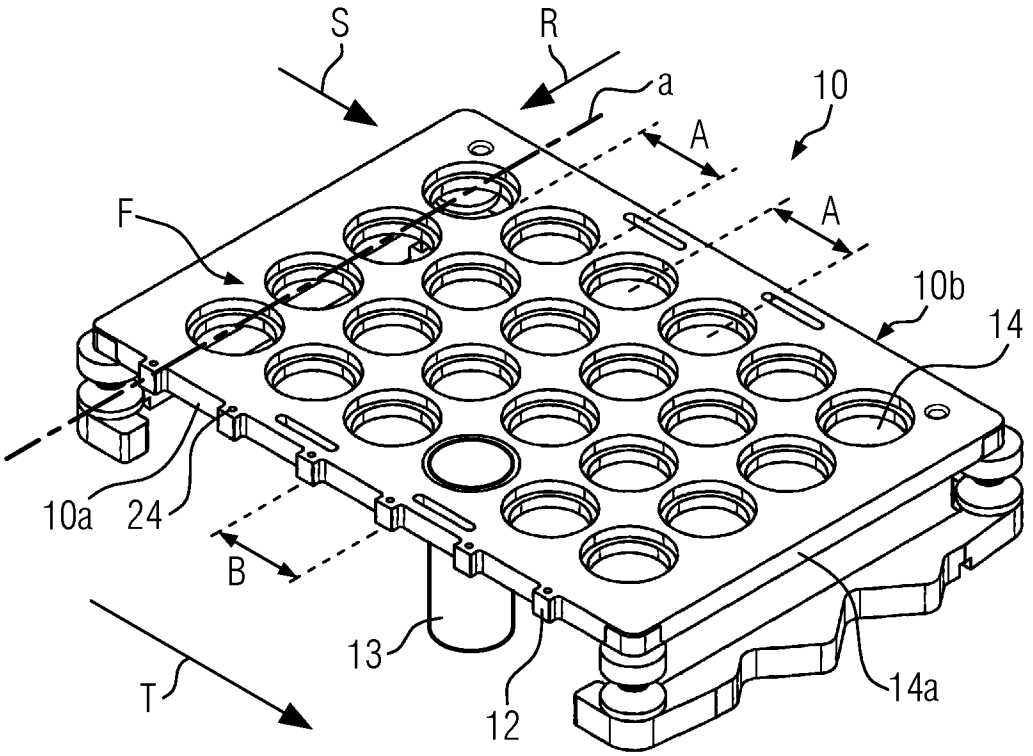
FIG. 3 is a perspective view of a first embodiment of an object carrier.

FIG. 3 shows a schematic view of an object carrier 10 having an array F with n=6 rows R and m=4 lanes S of openings 14 in a carrier plate 14*a*. Each opening may be adapted to receive a package tray 13, wherein each opening may constitute a receptacle 14. Object carrier 10 shown in FIG. 3 is therefore configured to receive twenty-four trays 13 in twenty-four receptacles 14. Object carrier 10 can comprise two mutually parallel outer sides 10*a*, 10*b* which are here shown as two mutually parallel outer sides of carrier plate 14*a*. Adjacent rows R of receptacles 14 are spaced at a distance A. As shown in FIG. 3, this distance A can be measured either as the center-to-center distance of two adjacent rows R, or as the distance between corresponding outer edges of receptacles A in two adjacent rows R.

One notch element 12 may be provided for each row R on the left side 10*a* of object carrier 10 in the direction of transport T. Notch element 12 can be arranged at least approximately in alignment with the axis of symmetry a of rows R. A stop system 11 can stop this object carrier 10 for each individual row R to enable chronologically consecutive processing of individual row R of trays 13 by processing unit 4, 5, 6, 7, 8. A centering element 24 may be provided for each notch element 12 in the region of notch elements 12 in the form of a centering hole for being positioned precisely by an associated centering device of processing unit 4, 5, 6, 7, 8. Notch elements 12 on side 10*a* of object carrier 10 can be arranged equidistant from one another. In FIG. 3, adjacent notch elements 12 are spaced at a distance B which is presently identical to distance A between two rows R of receptacles 14.

Figure 4:
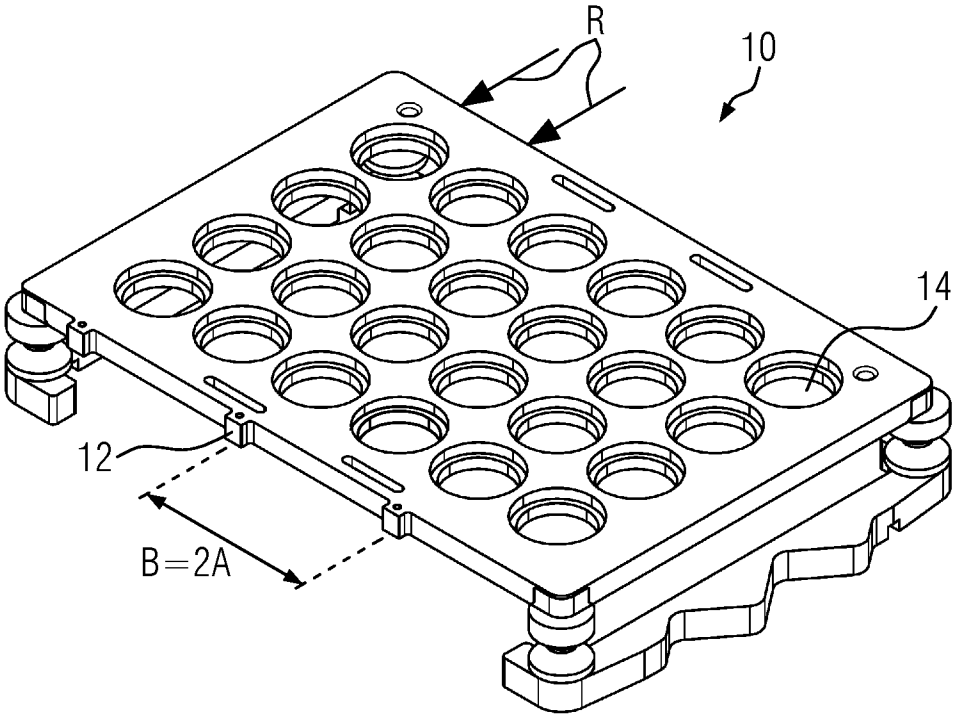
FIG. 4 is a perspective view of a second embodiment of an object carrier.

FIG. 4 shows a second embodiment of object carrier 10, where twenty-four receptacles 14 are also provided like in FIG. 3, but with only three notch elements 12. In this embodiment, processing of two rows R or eight trays 13, respectively, is intended by way of processing unit 4, 5, 6, 7, 8. In this embodiment, the distance B between notch elements 12 is equal to twice the distance A between two rows R (i.e., B=2*A).

Figure 5:
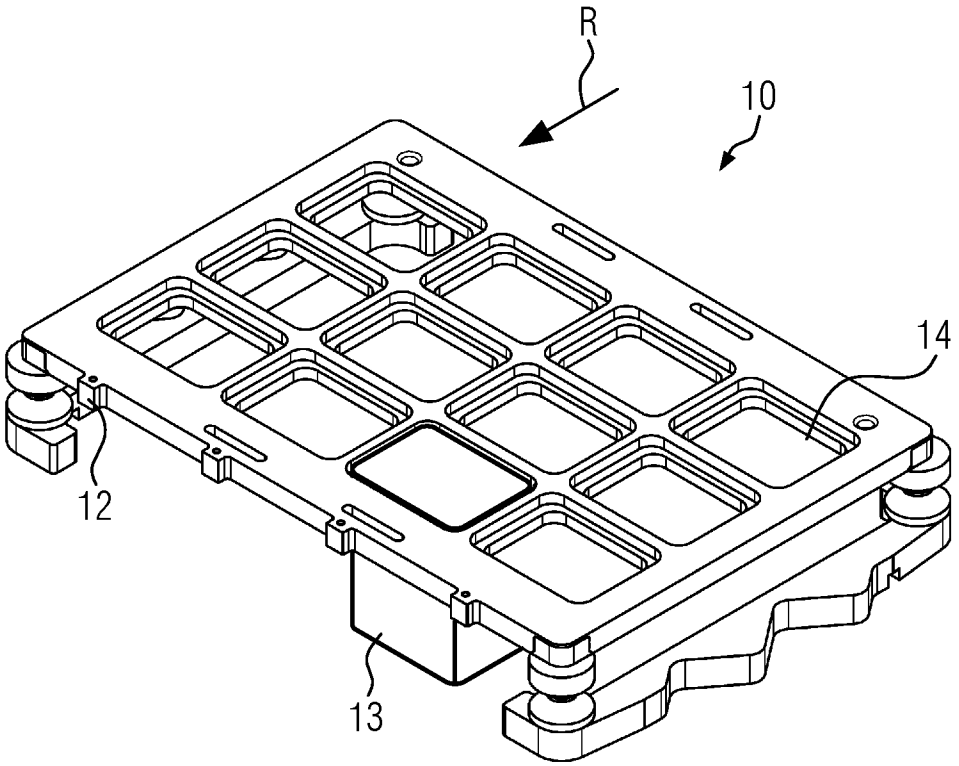
FIG. 5 is a perspective view of a third embodiment of an object carrier.

FIG. 5 shows a third embodiment of object carrier 10 with a different geometric shape of individual tray receptacles 14 and a division of the array F of tray receptacles 14 with n=4 rows R and m=3 lanes S, (i.e., with a reception capacity of twelve trays 13). Like in FIG. 3, one notch element 12 can be provided for each row R. This division optionally enables either stopping individual rows R in rows for processing or also stopping every second notch element 12, for example, where simultaneous processing of two rows R is intended.

Figure 6:
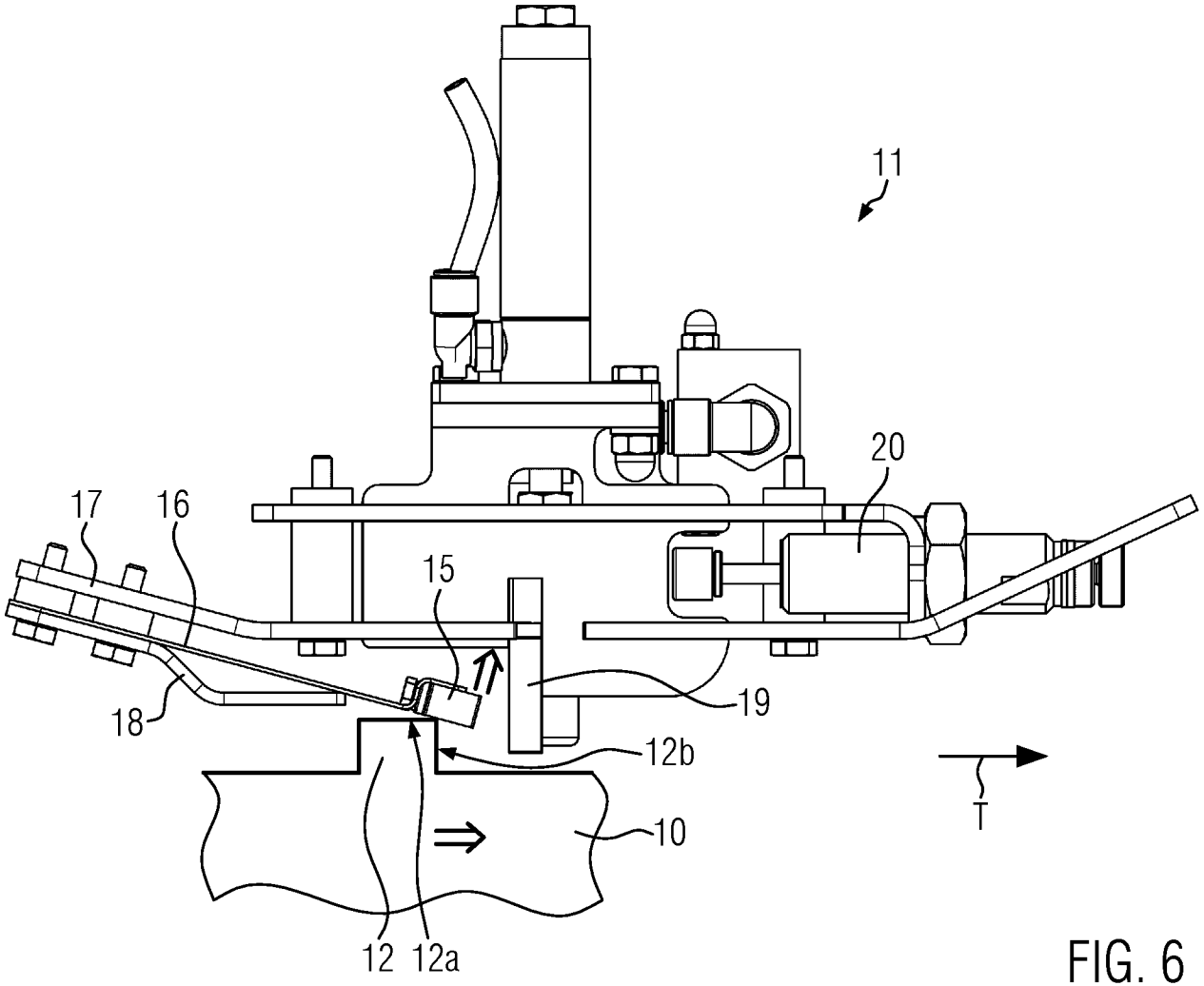
FIG. 6 is a plan view of a stop system in a standby position according to one embodiment of the present invention.
Figure 7:
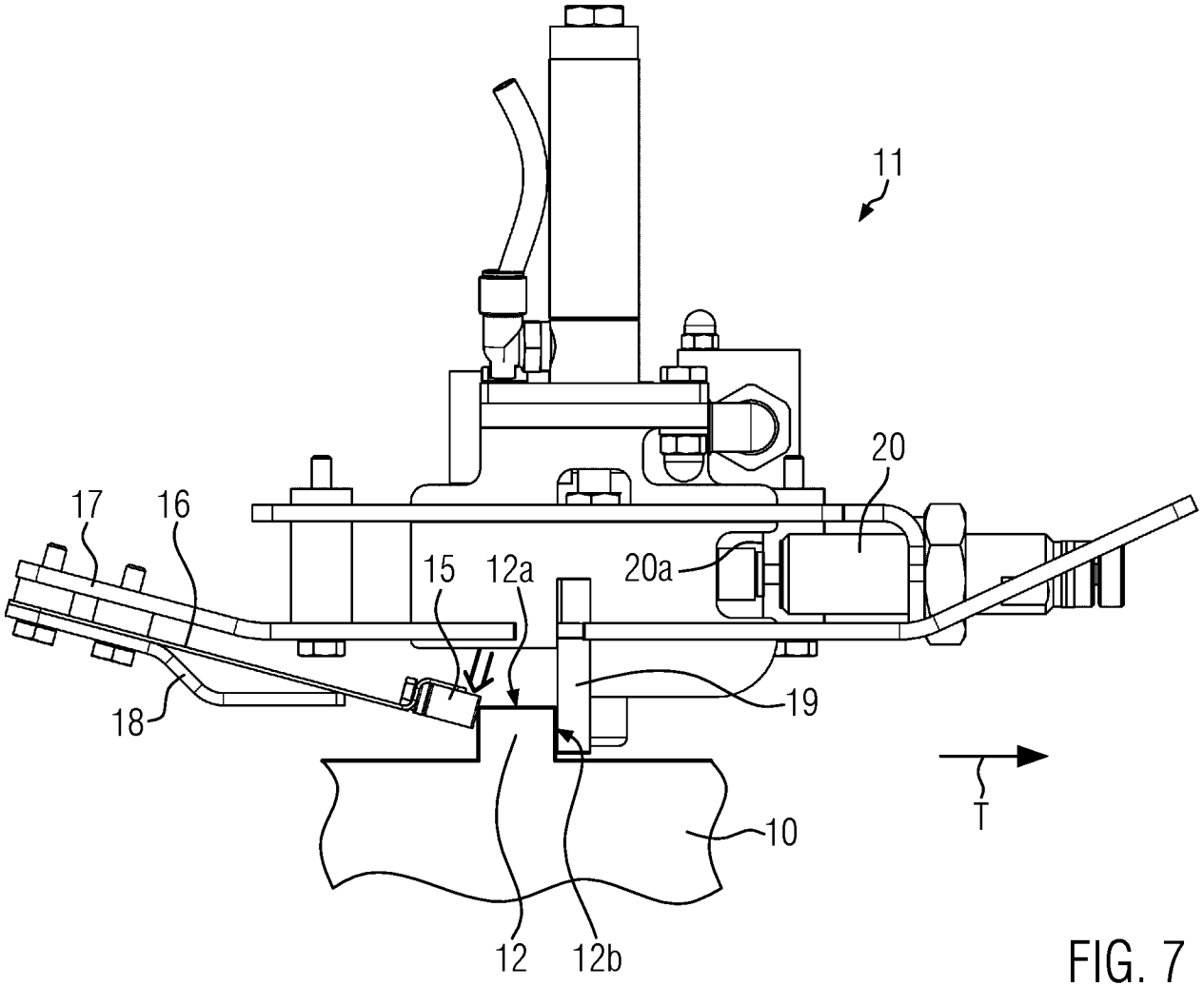
FIG. 7 is a plan view of the stop system of FIG. 6 in a working position.

FIG. 6 shows a plan view of stop system 11 in the standby position for receiving notch element 12 of an object carrier 10 in the direction of transport T. Stop system 11 can comprise a return pawl 15 which is by way of a spring element 16, presently illustrated as a spring plate, disposed on a frame 17 of stop system 11. A limiting element 18, likewise being mounted on frame 17, can be provided to limit the motion of return pawl 15 in the direction of object carrier 10. Stop system 11 can include a stop 19 that may be movable via a damping device 20 by notch element 12 of object carrier 10 in the direction of transport T, namely to the extent that notch element 12 is held without play between return pawl 15 and stop 19 in a working position, as shown in FIG. 7.

During the transport motion of object carrier 10, notch element 12 with its outer side 12*a* may push return pawl 15 away in the direction of the arrow such that spring element 16 experiences increased pre-tension. Once notch element 12 has moved in the direction of transport T with its outer side 12*a* past return pawl 15, return pawl 15 may again move against the direction of the arrow back to the position in which return pawl 15 abuts limiter 18. During the motion of notch element 12 along return pawl 15, a front side 12*b* of notch element 12 may push against stop 19 and moves stop 19 against damping device 20 which decelerates this motion and brings it to a standstill nearly or directly at a stop 20*a* of damping device 20. This position corresponds to the position at which outer side 12*a* of notch element 12 has left return pawl 15 and return pawl 15 springs back against the direction of the arrow (FIG. 6) and notch element 12 can thereby be stopped and positioned almost without play or at least with a tolerance of about +/−0.3 mm, for example, relative to stop system 11 and thus to work station 4, 5, 6, 7, 8. This is shown in FIG. 7 in a plan view of stop system 11 in the working position.

Figure 8:
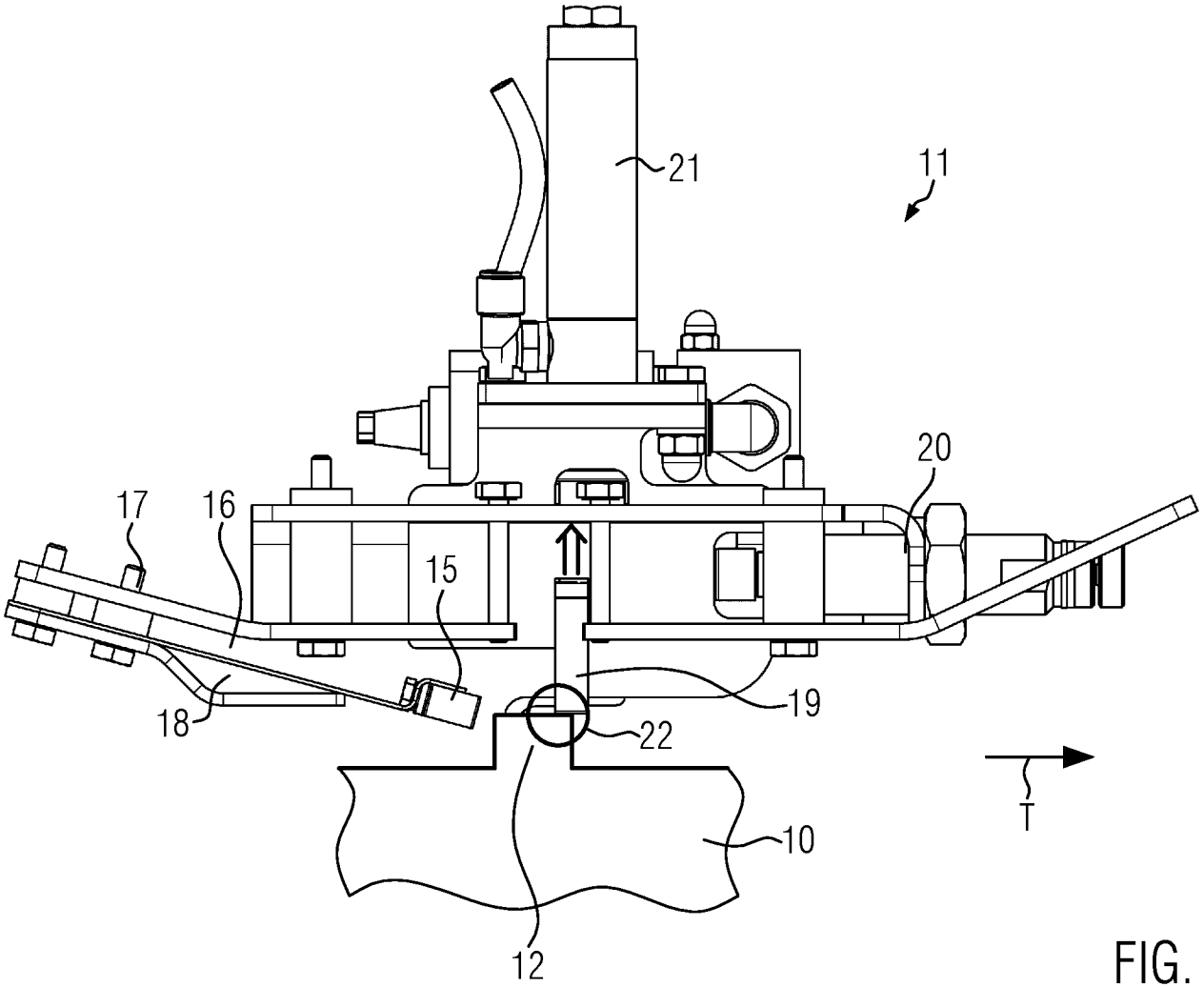
FIG. 8 is a plan view of the stop system of FIG. 6 in a release position.

FIG. 8 shows a plan view of stop system 11 in a release position in which stop 19 was retracted by use of a pneumatic cylinder 21 into stop system 11 while withdrawing from object carrier 10 in the direction of the arrow in order to enable movement of object carrier 10 in the direction of transport T. Once notch element 12 has been moved past stop 19, pneumatic cylinder may 21 push stop 19 against the direction of the arrow back to the working position when the next arriving notch element 12 of the current or a subsequent object carrier 10 is to be stopped for processing by processing unit 4, 5, 6, 7, 8. A sensor 22 of stop system 11 can be configured such that it can detect whether a notch element 12 is located in its working position at stop 19, and can also detect whether or not that notch element 12, after stop 19 is moved away perpendicular to the direction of transport T, has left the movement region of stop 19. In one embodiment, sensor 22 is able to detect the position of the notch element without being influenced by the presence or absence of stop 19. For this purpose, for example, notch element 12 can be metallic and stop 19 can be formed from plastic. If, for example, an inductive or capacitive sensor is used as sensor 22, then it alone detects the position of notch element 12, unaffected by the presence or absence of stop 19.

Figure 9:
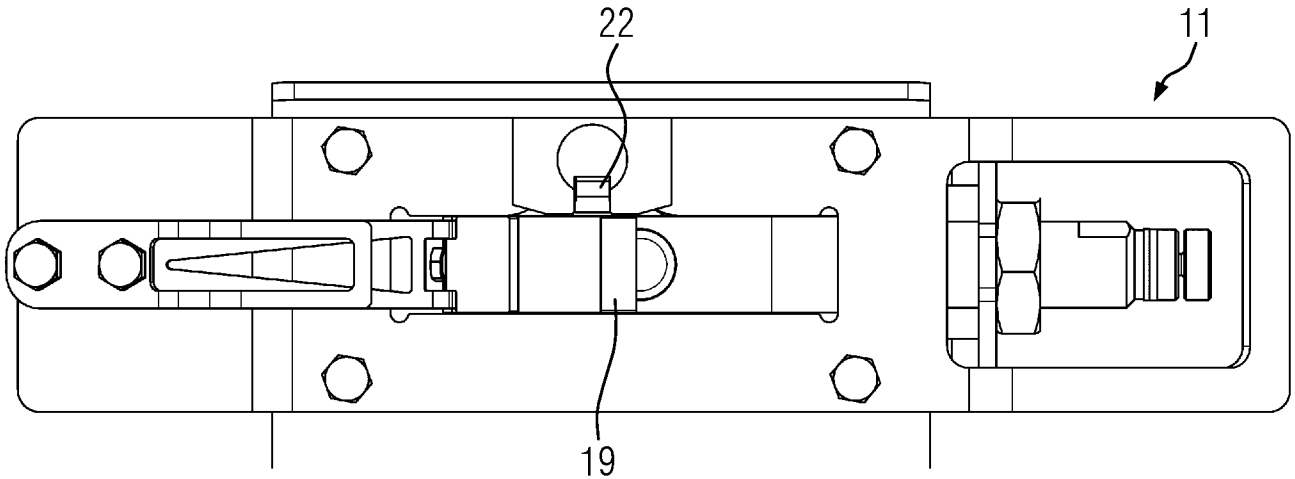
FIG. 9 is a front view of a stop system in a standby position according to one embodiment of the present invention.
Figure 10:
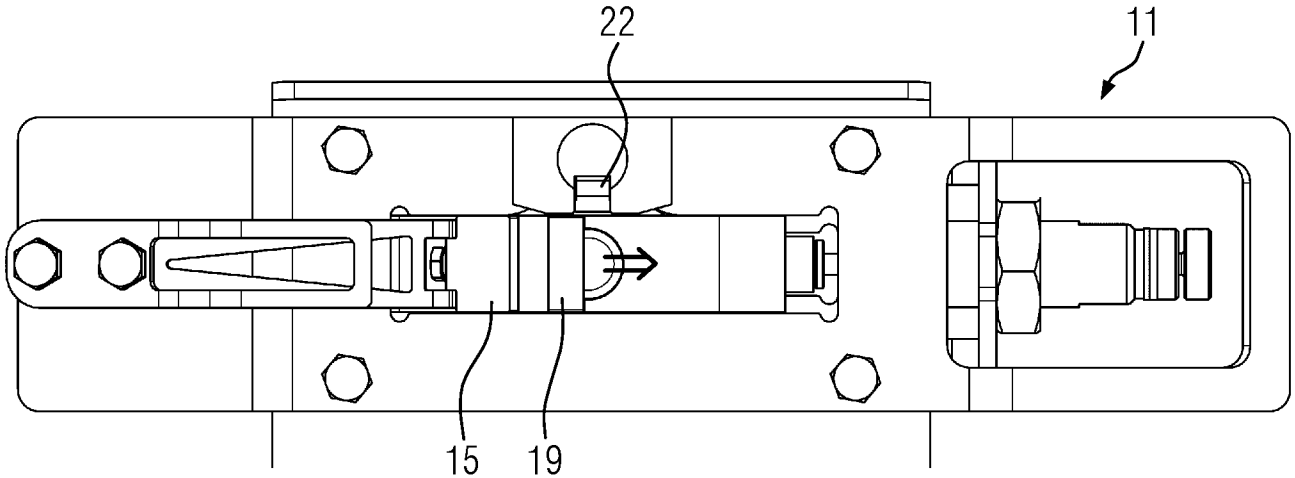
FIG. 10 is a front view of the stop system of FIG. 9 in a working position.

FIG. 9 shows a front view of stop system 11 in the standby position in which stop 19, like shown in FIG. 5, has not yet been moved to the right by a notch element 12 of an object carrier 10. FIG. 10 shows a front view of stop system 11 in the working position, in which stop 19, like in FIG. 7, is moved to the right to the extent that notch element 12 (not shown in more detail in FIGS. 9 and 10) is held between return pawl 15 and stop 19. Sensor 22 is shown as disposed above stop 19. Also conceivable is an arrangement of sensor 22 below stop 19 in order to be activated in a like manner by notch element 12.

A variant of object carrier 10 is also conceivable comprising notch elements 12 on two oppositely disposed sides, namely the outer sides in the direction of transport T being the right and the left sides, to be able to provide stop element 11 on different sides at different processing units 4, 5, 6, 7, 8. The position of notch elements 12 of the two sides can differ from the orientation, for example, relative to the axes of symmetry A, of rows R.

Each processing unit 4, 5, 6, 7, 8 can comprise its own controller; or a controller 23 of tray sealer 2, as shown in FIG. 1, may control one or more stop systems 11 along transport system 2, and optionally also one or more processing units 4, 5, 6, 7, 8.

Conveyor belts 9 shown in FIG. 1 can have a uniform speed, where these conveyor belts 9, for example, may be configured as link belts, or exhibit friction that allows object carriers 10 to be stopped by stop systems 11 while conveyor belts 9 continue to move along under object carriers 10 resting thereon.

As an alternative to a stop 19 that is movable in the direction of transport T and acting together with a damping device 20, a stop can also be provided in the direction of transport mounted on stop system 11 in a stationary manner. In such an embodiment, object carrier 10 is by way of the controlled speed of conveyor belt 9 in a decelerated manner driven against stop 19 in order to prevent products from spilling out from tray 13, in particular liquid or pasty materials.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. Packaging system comprising:

a packaging machine;

a transport system;

at least one processing unit;

a plurality of object carriers, each of said plurality of object carriers including a plurality of notch elements spaced at a first distance and a plurality of rows of receptacles for receiving packaging trays, wherein said plurality of rows of receptacles comprises an "n" number of rows of receptacles and wherein said number "n" is at least two, and wherein adjacent rows of receptacles on each object carrier are spaced at a second distance, wherein said first distance is equal to said second distance or an integral multiple of said second distance; and one or more stop systems provided along said transport system and configured to stop an individual object carrier intermittently by engaging one or more of the plurality of notch elements of said individual object carrier to position one of said plurality of said rows of receptacles of said individual object carrier to be processed by said at least one processing unit.

2. Packaging system according to claim 1, wherein said at least one processing unit is a tray loader, a filler, a product loader, a capper, a robot, or a labeler.

3. Packaging system according to claim 1, wherein said packaging machine is a tray sealer.

4. Packaging system according to claim 1, wherein said processing unit comprises a centering device being configured to align said object carrier by way of a centering element provided for each said notch element.

5. Packaging system according to claim 1, wherein said one or more stop systems comprise a stop member moveable in a direction substantially perpendicular to a direction of transport of said transport system, said stop member moveable between a working position at which said stop member engages one or more notch elements of said individual object carrier and a release position at which said stop member is no longer in engagement with said one or more notch elements.

6. Packaging system according to claim 1, wherein said transport system is a conveyor belt.

7. Packaging system according to claim 6, wherein said plurality of object carriers travel on said conveyor belt.

8. Packaging system according to claim 7, wherein said stop system stops travel of said of said individual object carrier in the transport direction while said conveyor belt is still moving.

9. Packaging system according to claim 8, wherein said stop system comprises a stop member moveable in a direction substantially perpendicular to a direction of transport of said transport system, said stop member moveable between a working position at which said stop member engages one or more notch elements of said individual object carrier and a release position at which said stop member is no longer in engagement with said one or more notch elements.

10. Packaging system according to claim 9, wherein said stop system further comprises a return pall member disposed for movement between a default position and a displaced position, wherein said return pall member is disposed upstream of the stop member in the direction of transport.

11. Packaging system according to claim 10, and wherein said return pall member is mounted on a spring and is moved from said default position to said displaced position by said one or more notch elements as said one or more notch elements of said individual object carrier moves in the direction of transport at said stop system adjacent to said return pall member, and wherein said return pall member springs back into said default position after said one or more notch elements of said individual object carrier travels past said return pall member, thereby securing said one or more notch elements of said individual object carrier between said stop member and said return pall member.

* * * * *